United States Patent [19]

McElhaney et al.

[11] Patent Number: 5,074,834

[45] Date of Patent: Dec. 24, 1991

[54] METHOD OF MAKING MULTI-CELL CONTAINER CELL UNIT

[75] Inventors: William L. McElhaney; Roger N. Floyd; Farris N. Duncan, all of West Monroe, La.

[73] Assignee: Georgia-Pacific Corporation, Atlanta, Ga.

[21] Appl. No.: 596,612

[22] Filed: Oct. 17, 1990

Related U.S. Application Data

[63] Continuation-in-part of Ser. No. 424,173, Oct. 14, 1989.

[51] Int. Cl.[5] ..... B31B 3/62; B31B 7/26

[52] U.S. Cl. ..... 439/273; 493/89; 493/128; 493/276; 493/295; 493/912

[58] Field of Search ..... 493/89, 90, 121, 128, 493/129, 130, 273, 276, 295, 912

[56] References Cited

U.S. PATENT DOCUMENTS

| | | | |
|---|---|---|---|
| 547,833 | 10/1895 | Asam et al. . | |
| 1,098,322 | 5/1914 | Johnson . | |
| 1,225,705 | 5/1917 | Dyson et al. . | |
| 1,767,629 | 6/1930 | Walter . | |
| 1,826,197 | 10/1931 | Adams . | |
| 1,882,524 | 10/1932 | Sherman . | |
| 2,135,140 | 11/1938 | Magers . | |
| 2,247,341 | 6/1941 | Anderson . | |
| 2,588,455 | 3/1952 | Adams . | |
| 2,968,397 | 1/1961 | Cantrell . | |
| 3,393,613 | 7/1968 | Shields | 493/295 |
| 3,403,835 | 10/1968 | Schwaner . | |
| 3,423,008 | 1/1969 | Mykleby . | |
| 3,481,525 | 12/1969 | Pierce . | |
| 3,628,718 | 12/1971 | Broyles . | |
| 3,715,072 | 2/1973 | Muskopf et al. . | |
| 3,754,456 | 8/1973 | Andrews et al. | 493/276 |
| 4,294,359 | 10/1981 | Berkel . | |
| 4,351,471 | 9/1982 | Dunkle . | |
| 4,371,366 | 2/1983 | Bower et al. | 493/912 |
| 4,580,718 | 4/1986 | Muise . | |

FOREIGN PATENT DOCUMENTS

| | | |
|---|---|---|
| 2160850A | 1/1986 | United Kingdom . |

*Primary Examiner*—William E. Terrell

*Attorney, Agent, or Firm*—Banner, Birch, McKie & Beckett

[57] ABSTRACT

A blank for constructing a cell unit includes first, second, third, and fourth walls which each have inner and outer planar surfaces and are separated by fold lines. Each of the walls have upper and lower flaps, the upper and lower flaps of the first wall having tabs extending therefrom. The first and fourth walls of the blank are folded along respective fold lines such that the tabs extending from the upper and lower flaps of the first wall are respectively disposed on the upper and lower flaps of the fourth wall. An adhesive is applied to at least the outer planar surface of the first, second, third, and fourth walls. The upper and lower flaps of the first, second, third, and fourth walls are folded to adhesively secure the flaps to the respective outer surfaces of the first, second, third, and fourth walls and the tabs are adhesively secured to the fourth wall.

3 Claims, 4 Drawing Sheets

METHOD OF MAKING MULTI-CELL CONTAINER CELL UNIT

CROSS REFERENCE TO RELATED APPLICATIONS

This application is a continuation-in-part application of commonly assigned, copending application Ser. No. 07/424,173, filed Oct. 19, 1989.

TECHNICAL FIELD

The present invention is generally related to multi-cell containers and, more particularly, to a method of forming multi-cell shipping containers for uncured rubber products.

BACKGROUND OF THE INVENTION

Packages and shipping containers are generally designed and constructed in accordance with the characteristics of the product or material contained therein. Uncured rubber products and other materials having inherent cold flow characteristics require packages and shipping containers having sufficient strength and/or other features to address the problem of a product which is likely to undergo significant deformation and change of shape during shipping, handling, and subsequent storage. U.S. Pat. No. 3,715,072 to Muskopf et al. discloses a multi-cell paperboard container particularly adapted for shipping and storing material having cold-flow characteristics, such as synthetic rubber, which exerts great pressure against the cell walls. The coextensive facing walls of the independent cells are secured together by a reenforcing sheet coextensive with and bonded by adhesive to such facing walls. This arrangement serves to strengthen the cells, to enhance bulge resistance, and to distribute pressure uniformly along the facing walls.

U.S. Pat. No. 2,968,397 to Cantrell, Sr. discloses a shipping container for bales of unvulcanized rubber products. A tubular bale holder is constructed to contain a plurality of bales, each bale holder having a cross-sectional configuration greater than the cross-sectional configuration of the bales to be contained therein. When the bales become distorted during storage or handling, they snuggly fit within and abut against the walls of the bale holders.

In addition to having sufficient strength or some other feature to allow for deformation, packages and shipping containers for uncured rubber should desirably reduce or eliminate the introduction of contaminants therein. Contamination of the uncured rubber degrades the quality of products subsequently formed therefrom. In particular, prior art multi-cell shipping containers for uncured rubber suffer from the introduction of dust into the rubber, notably dust from the rough edges of the material from which the cell units are constructed. As described in above-referenced U.S. Pat. No. 3,715,072, cell units are typically formed from corrugated board, fiberboard, or paperboard. Such a cell is illustrated in FIG. 1. Cell unit 1 includes an upper edge 2 and a lower edge 3. Since the board from which the cell unit is formed is typically die cut, edges 2 and 3 are rough and uneven. Any sliding contact with such edges by the product contained within the cell or with other portions of the container can produce rips and tears in a bag or container housing the product and can also generate fine dust particles from abrasion. The introduction of these dust particles, as noted, degrades the quality of the rubber.

Although the strength of a cell unit and the reduction of the introduction of contaminants such as dust is described above in terms of a shipping container for uncured rubber products, such considerations are important in many situations. for instance, the shipping of food such as fruit can require a container having strength and which advantageously includes an arrangement for reducing the introduction of contaminants thereto.

SUMMARY OF THE INVENTION

Accordingly, it is an object of the present invention to provide a method for constructing a multi-cell container.

It is another object of the present invention to provide a method for constructing a cell unit having a release coating applied thereto.

It is another object of the present invention to provide a multi-cell container having cell units of sufficient strength to contain a material having cold flow characteristics.

It is another object of the present invention to provide a multi-cell container having cell units including a double wall structure for increased strength.

It is still another object of the present invention to provide a multi-cell container having cell units which reduce the introduction of contaminants such as dust into the product contained therein.

In accordance with the present invention, a cell unit is provided for use in a multi-cell container. The cell unit includes a plurality of walls, each wall having opposed inner and outer planar surfaces. The walls are arranged to form a cell having a predetermined volume defined by the inner planar surfaces of the walls. Each wall includes at least an upper and a lower flap. The upper and lower flap of each wall is adhesively secured to the outer planar surface thereof. A blank for constructing a cell unit in accordance with the invention includes first, second, third, and fourth walls which each have inner and outer planar surfaces and are separated by fold lines. Each of the walls have upper and lower flaps, the upper and lower flaps of the first wall having tabs extending therefrom. The first and fourth walls of the blank are folded along respective fold lines such that the tabs extending from the upper and lower flaps of the first wall are respectively disposed on the upper and lower flaps of the fourth wall. An adhesive is applied to at least the outer planar surface of the first, second, third, and fourth walls. The upper and lower flaps of the first, second, third, and fourth walls are folded to adhesively secure the flaps to the respective outer surfaces of the first, second, third, and fourth walls and the tabs are adhesively secured to the fourth wall.

This construction provides dust free edges since the edges are not die cut and thus reduces the introduction of contaminants into a product contained within the cell. The interior of the cell and a bottom wall of a tray in which the cell is placed comprise a space having smooth surfaces and dust free edges. In addition, the smooth surfaces and edges serve to prevent punctures and rips in bags or other containers housing the product within the cell unit. The construction further provides a double-walled cell unit, affording a strong structure to resist wall deformation due to the movement or shifting of the product within the cell unit.

A tray for preferably containing three of the above-described cell units is also provided. The tray includes opposing shelf flaps for facilitating the stacking of a plurality of trays. The folding of the shelf flaps further serves to form raised wall portions which retain a stacked tray in a substantially fixed relation to the tray upon which it is stacked. An outer paperboard sleeve may be placed around a plurality of stacked trays, such an arrangement being subsequently covered and bound for shipment.

BRIEF DESCRIPTION OF THE DRAWINGS

A more complete appreciation of the present invention and many of the attendant advantages thereof will be readily obtained as the present invention becomes better understood by reference to the following detailed description and the accompanying drawings.

DETAILED DESCRIPTION OF THE PREFERRED EMBODIMENT

Although the preferred embodiment described below is particularly describes a shipping container for uncured rubber, it is emphasized that the teachings of the present invention may be broadly utilized when it is desired to provide a multi-cell container having strong cell units and/or which reduces the introduction of contaminants therein.

Figure 1:
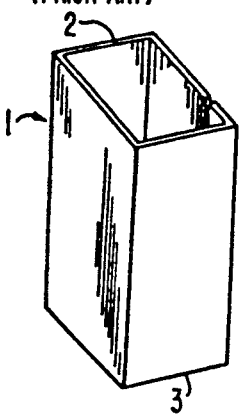
FIG. 1 (PRIOR ART)
FIG. 1 is an illustration of a prior art cell unit for use in a multi-cell container.
Figure 2:
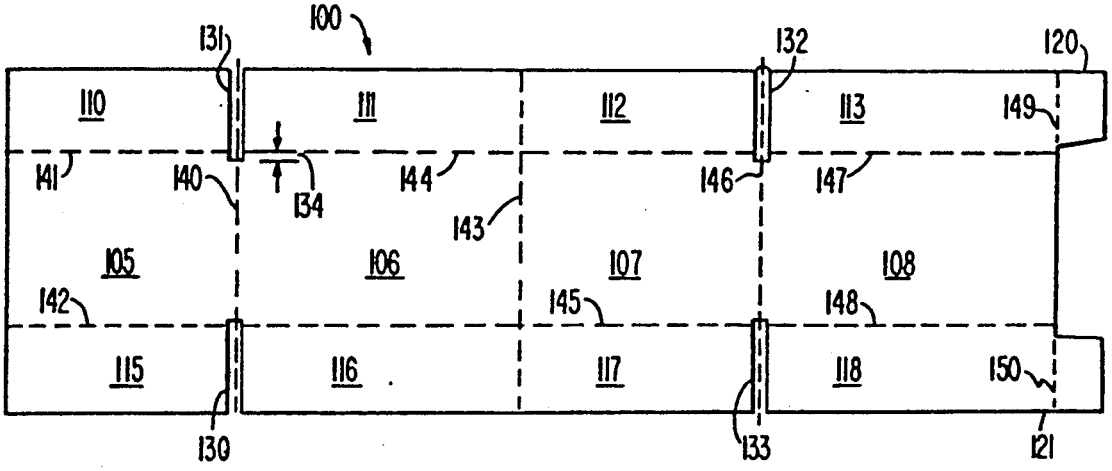
FIG. 2 illustrates a blank for forming a cell unit in accordance with the present invention.

FIG. 2 illustrates a blank for forming a cell unit in accordance with a preferred embodiment of the present invention. Blank 100 is preferably formed of corrugated cardboard, although other types of paperboard and fiberboard may be utilized and the invention is not limited in this respect. Blank 100 includes walls 105, 106, 107, and 108, upper flaps 110, 111, 112, and 113, and lower flaps 115, 116, 117, and 118. The width of the upper and lower flaps is preferably slightly less than one-half the height of the walls. Walls 105, 106, 107, and 108 each define opposed inner and outer planar surfaces. Inner as used herein will refer to the space of predetermined volume within the cell unit. Upper flap 113 and lower flap 118 are provided with glue tabs 120 and 121, respectively. The various component portions of the blank are separated one from the other by fold lines and score lines as described below. Wall 105 is separated from wall 106 by manufacturing joint or fold line 140. Upper flap 110 and lower flap 115 are separated from wall 105 by score lines 141 and 142, respectively. Fold line 143 separates (1) upper flap 111 from upper flap 112; (2) wall 106 from wall 107; and (3) lower flap 116 from lower flap 117. Upper flaps 111 and 112 are separated from walls 106 and 107 respectively by score line 144. Lower flaps 116 and 117 are separated from walls 106 and 107 respectively by score line 145. Fold line 146 separates wall 107 from wall 108. Upper flap 113 is separated from wall 108 by score line 147 and lower flap 118 is separated from wall 108 by score line 148. Glue tab 120 is separated from upper flap 113 by fold line 149 and glue tab 121 is separated from lower flap 118 by fold line 150. In a preferred embodiment, the above score-lines are preferably three point score lines, although the invention is not limited as such, and it will be apparent to those of ordinary skill that the type of score line will depend, inter alia, on the thickness and type of material used.

Blank 100 includes cut-out portions 130, 131, 132, and 133 for facilitating folding. Cut-out portion 130 is formed between lower flaps 115 and 116. Cut-out portion 131 is formed between upper flaps 110 and 111. Cut-out portion 132 is formed between upper flaps 112 and 113. Cut-out portion 133 is formed between lower flaps 117 and 118. Each of the cut-out portions is extended approximately ⅛ inch into the walls as indicated at 134. Cut-out portions 130 and 131 are substantially bisected by lines extended from fold line 140 while cut-out portions 132 and 133 are substantially bisected by lines extended from fold line 146. The cut-out portions facilitate folding during construction of the cell unit and also enable the flat storage of cell units after construction.

The cell unit is constructed as follows. Upper flaps 110, 111, 112, and 113 and lower flaps 115, 116, 117, and 118 are folded along the associated score lines and are adhesively secured to the outer planar surface of walls 105, 106, 107, and 108. Since the width of the flaps is slightly less than one-half the wall height, a seam 185 (See FIG. 3) is formed along the outer surface of the cell unit. The flaps may be glued, taped or otherwise adhesively secured to the outer planar wall surface and the invention is not limited in this respect. The resultant structure is then folded along fold lines 140, 143, and 146 and formed into a generally rectangular configuration. The inner planar surfaces of the walls define a cell having a volume which is dependent on the wall size. Glue tabs 120 and 121 are utilized to secure the cell unit in its rectangular configuration. Preferably, glue tabs 120 and 121 are glued or otherwise adhesively bonded to wall 105 and disposed between wall 105 and flaps 110 and 115.

Figure 3:
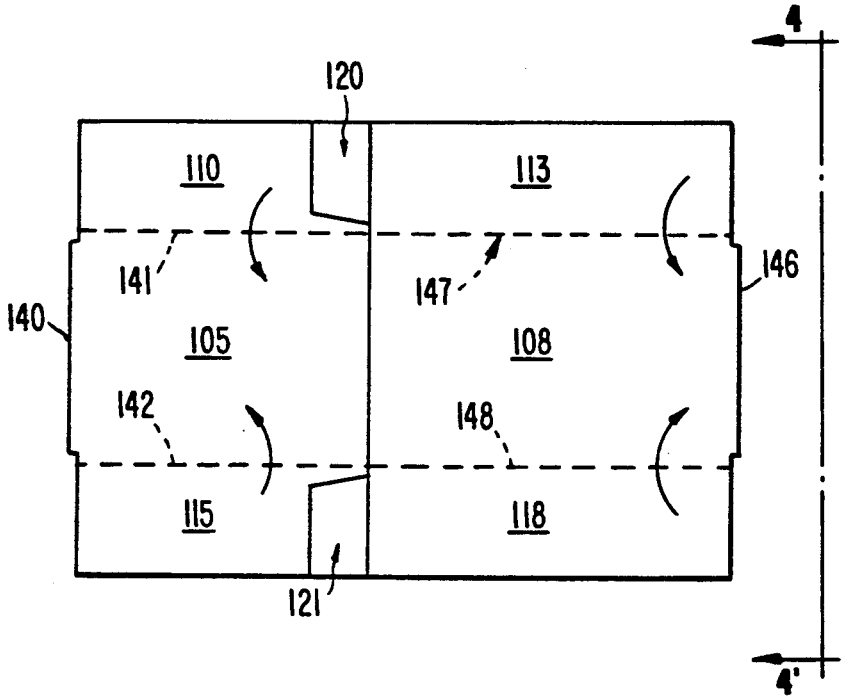
FIG. 3 illustrates the blank of FIG. 2 partially folded.

A cell unit utilizing the blank described above and formed in accordance with the present invention overcomes the problems of the prior art shipping containers described above. By folding and securing the flaps to the outer planar wall surface, cell unit edges 198 and 199 (See FIG. 3) are smooth and consequently less dust is generated by sliding contact therewith from abrasion. When the cell unit of the invention is disposed in a stackable tray such as that described in detail below, the smooth inner bottom surface of the tray, the cell unit, and the smooth outer bottom surface of a tray stacked thereon provide smooth contact surfaces for the product contained therein and sliding contact during shipping and handling is less likely to generate dust particles from abrasion and degrade the product. These smooth surfaces further prevent tearing or ripping of bags or containers housing a product within the cell unit. Further, as illustrated by FIG. 3, this construction provides a double wall structure, a first wall formed by one of the walls 105, 106, 107, and 108 and a second wall formed by the upper and lower flaps adhesively secured thereto. Thus, the cell unit of the present invention may be made with sufficient strength to provide for, for example, the cold flow characteristics of a material contained therein. As noted above, such strength is also useful in other applications and is not limited to containers for materials having cold flow characteristics.

In an improved embodiment, a cell unit of the present invention uses a blank as shown in FIG. 2 with one side thereof being applied with a release coating such as a silicon to further reduce the generation of fine dust particles due to sliding contact between the cell unit and the product contained therein. The release coating is applied to at least that portion of the blank which will form the inner planar surfaces of the walls. For the discussion below, it will be assumed that the release coating is on the entire surface of the blank illustrated in FIG. 2. When one side of the blank is applied with a release coating, it is difficult to obtain a good adhesive bond between the glue tabs having the release coating and the flaps 110 and 115 when the blank of FIG. 2 is folded along fold lines 140 and 146 (as shown in FIG. 3) during the process of forming the cell unit. If the glue tabs are not securely bonded, the integrity and useful lifetime of the cell unit is comprised. Thus, a preferred method of forming the cell unit is described below.

Figure 4:
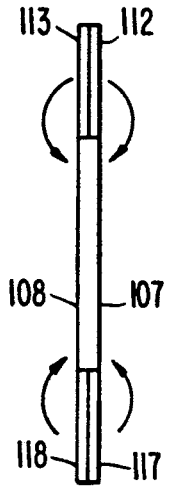
FIG. 4 is an end view along line 4—4' of FIG. 3.
Figure 5:
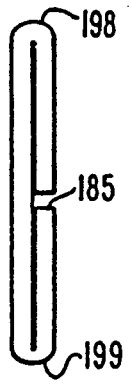
FIG. 5 is a cross-sectional view of a cell unit formed in accordance with the present invention.

The blank of FIG. 2 is folded in a direction out of the plane of FIG. 2 along fold lines 140 and 146 resulting in a structure as shown in FIG. 3. As noted above, the cut-out portions 130–133 facilitate folding along fold lines 140 and 146 and further enable the flat storage of cell units after construction. No glue or other adhesive is applied to the glue tabs at this time since the respective surfaces of glue tabs 120 and 121 which are in contact with flaps 110 and 115 have a release coating thereon and an ineffective bond would result. When the flaps are glued back to form the cell unit as shown in FIG. 4, the adhesive, such as a hot melt adhesive, glues the flaps back and bonds the glue tabs 120, 121 to wall 105 to maintain the rectangular configuration. Accordingly, glue tabs 120, 121 are adhesively bonded only to wall 105 and not to flaps 110, 115. As noted above, the resultant structure is then folded along fold lines 140, 143, and 146 into a rectangular configuration. The glue may be applied to the wall portions or to the wall portions and the flaps. Tape may also be utilized.

Thus, a cell unit constructed in accordance with this improved technique provides a double walled structure, both the outer and inner planar surfaces of which have a release coating by virtue of folding the flaps, and well-secured glue tabs for maintaining the cell unit in a rectangular configuration which are secured in a manner which avoids problems associated with gluing or adhesively securing a glue tab having a release coating on one side thereof.

It should be further emphasized that the advantages taught by the present invention are not limited to the particular embodiment disclosed above. For example, the cell unit is not limited to a four-sided substantially rectangular shape. A cell unit having any number of sides may be provided. In addition, it is not necessary that the cell units within a container be formed by a plurality of individual cell units. For 'example, four L-shaped dividers may be formed and disposed so as to form a multi-cell container.

Figure 6:
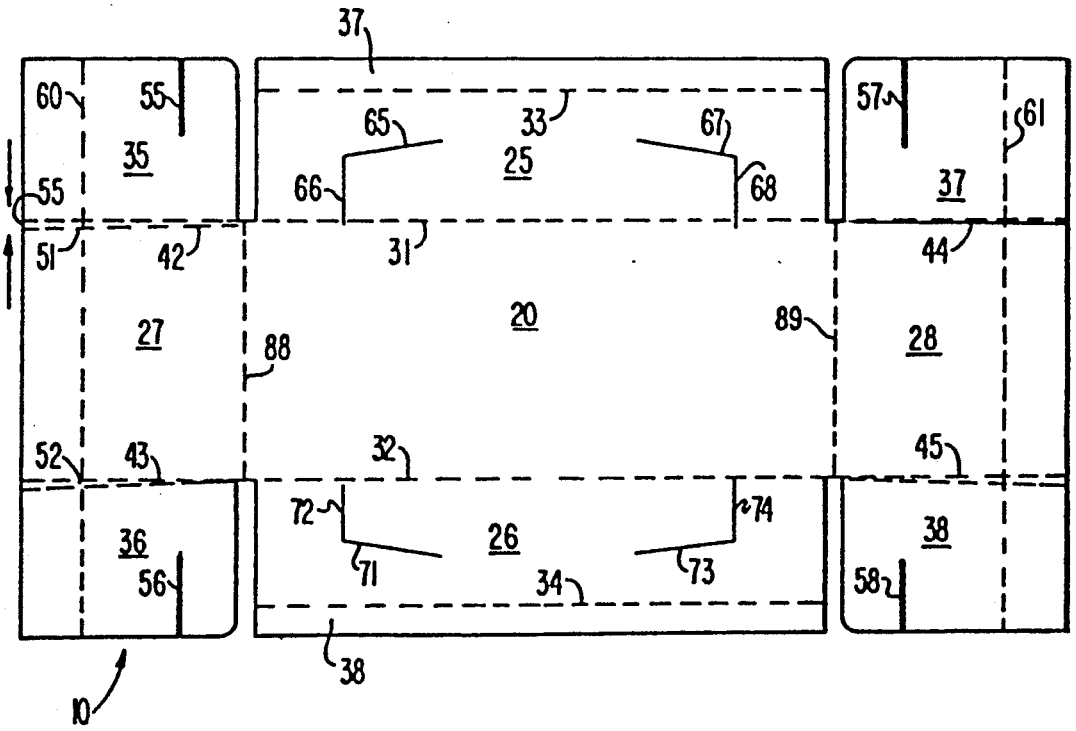
FIG. 6 illustrates a blank for a tray which may be utilized with the cell unit of the present invention.

FIG. 6 illustrates a blank for forming a tray which may be utilized with the above-described cell unit. Blank 10 includes bottom wall 20, side walls 25 and 26, and end walls 27 and 28. The various components of the blank are separated from each other by various fold lines and score lines as described below. Side walls 25 and 26 are separated from bottom wall 20 by fold lines 31 and 32, respectively. Shelf flaps 37 and 38 are respectively separated from side walls 25 and 26 by fold lines 33 and 34 respectively. End walls 27 and 28 are separated from bottom wall 20 by fold lines 88 and 89, respectively. Locking flaps 35 and 36 are separated from end wall 27 by fold lines 42 and 43 respectively. Similarly, locking flaps 37 and 38 are separated from end wall 28 by fold lines 44 and 45 respectively. Fold lines 42 and 43 are slightly tapered such that end wall 27 is substantially trapezoidal in shape. This taper is shown with respect to reference lines 51 and 52 and spacing 55 is preferably in the range from about ¼ to 3/16 of an inch. Fold lines 44 and 45 are similarly tapered such that end wall 28 is substantially trapezoidal in shape. A score line 60 is provided which extends from locking flap 35, along end wall 28, to locking flap 36. Similarly, a score line 61 is provided which extends from locking flap 37, along end wall 28, to locking flap 38.

Locking flaps 35, 36, 37, and 38 include locking slits 55, 56, 57, and 58, respectively. Side wall 25 includes insertion slits 65,66 and 67,68. Side wall 26 includes insertion slits 71, 72 and 73, 74. Construction of the tray is accomplished by folding the side walls and end walls along the respective fold lines and engaging the respective locking slits with the corresponding insertion slit. The trapezoidal end walls produce a tray having a slight outwardly tapered configuration to facilitate the stacking of additional trays thereon. Shelf flaps 37 and 38 are folded along fold lines 33 and 34 respectively to provide support for a tray stacked thereon. For a tray upon which another tray is to be stacked end walls 27 and 28 and locking flaps 35, 36, 37, and 38 are not folded along respective fold lines 60 and 61. The subsequent folding of shelf flaps 37 and 38 creates raised wall portions 96, 97, 98, and 99 (FIG. 7) which serve to retain a stacked tray in a substantially fixed relation to the tray upon which it is stacked. For an uppermost tray, the end walls and locking flaps are folded outwardly along fold lines 60 and 61 to facilitate the positioning of a cover. Each tray preferably contains three cell units although the invention is not limited in this respect.

Figure 7:
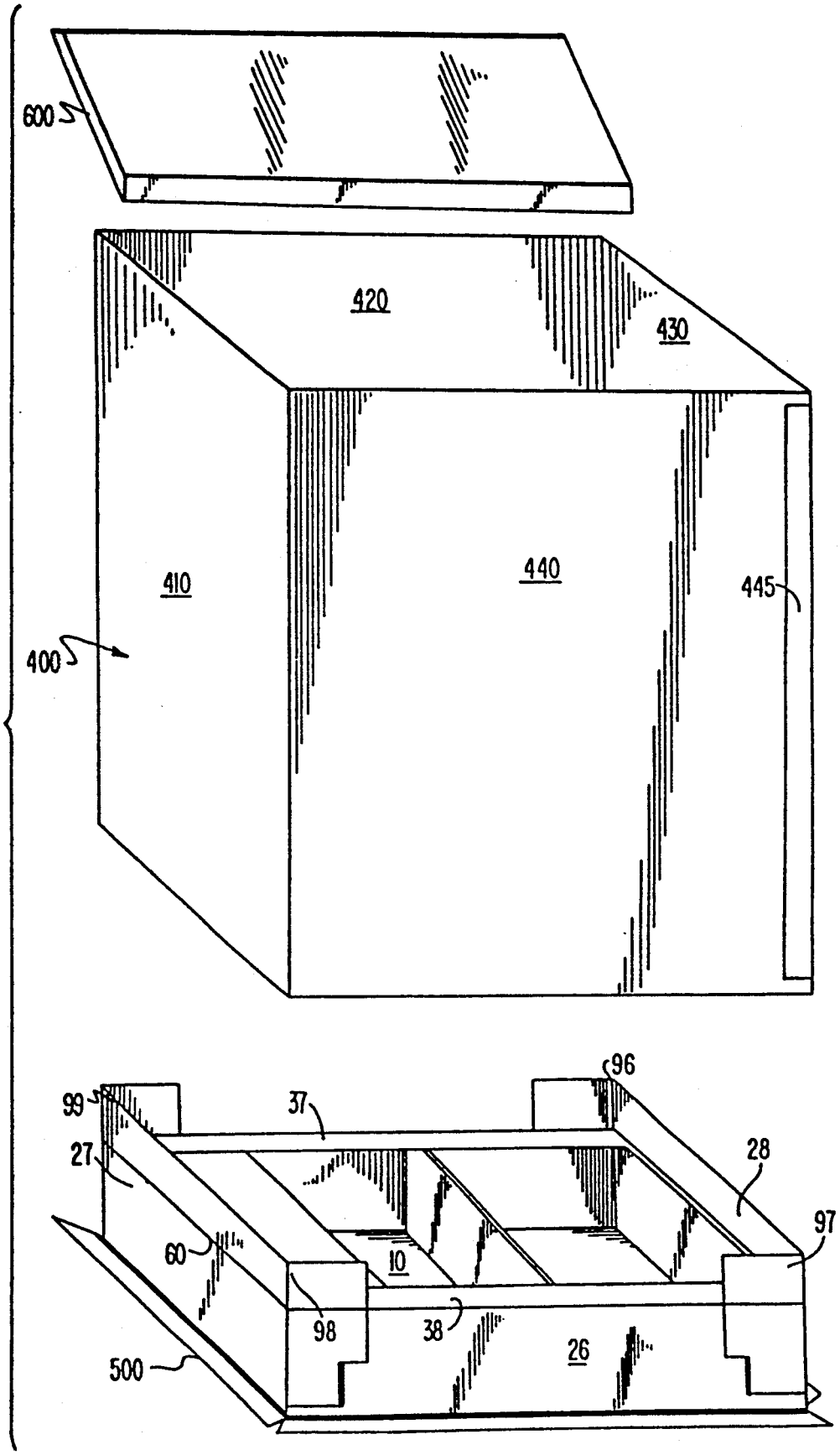
FIG. 7 is an exploded view of a shipping container utilizing the cell unit of the present invention.

An outer sleeve is provided in a preferred embodiment for placement over a plurality of the above-described multi-tray unit. Such an outer sleeve is illustrated in FIG. 7. Outer sleeve 400 includes wall portions 410, 420, 430, and 440 and glue tab 445. The sleeve is preferably of sufficient size to enclose five trays of cell units, although the invention is not limited in the respect and any number of trays may be stacked. This variable stacking reduces wasted space in both shipping and storing since trays may be stacked in accordance with the space available. FIG. 7 further illustrates a pallet 500 upon which the trays are stacked and a top 600 for covering the upper tray. The arrangement may be bound with tape or plastic for shipping. The particular configurations of the top and pallet are not critical to the present invention.

It is understood that various modifications of the present invention other than those disclosed herein may be practiced by those skilled in the art within the spirit of the invention and the scope of the appended claims.

We claim:

1. A method of constructing a cell unit from a blank comprising first, second, third, and fourth walls each having inner and outer planar surfaces and separated by fold lines, each of said walls having upper and lower flaps, the upper and lower flaps of said first wall having tabs extending therefrom, the method comprising the steps of:

folding said first and fourth walls of said blank along respective fold lines such that the tabs extending from the upper and lower flaps of said first wall are respectively disposed on the upper and lower flaps of said fourth wall;

applying an adhesive to at least the outer planar surface of said first, second, third, and fourth walls; and folding the upper and lower flaps of said first, second, third, and fourth walls to adhesively secure said flaps to the respective outer surfaces of said first, second, third, and fourth walls and to adhesively secure said tabs to said fourth wall.

2. The method in accordance with claim 1 further comprising the step of:

applying a release coating to the inner surface of said first, second, third, and fourth walls.

3. The method in accordance with claim 1 wherein the step of applying an adhesive comprises applying a hot melt adhesive.

* * * * *